United States Patent [19]

Murphy

[11] Patent Number: 4,818,918

[45] Date of Patent: Apr. 4, 1989

[54] HIGH FREQUENCY LIGHTING SYSTEM FOR GAS DISCHARGE LAMPS

[76] Inventor: Pierce M. Murphy, 201 W. View Pl., LaCross, Wis. 54603

[21] Appl. No.: 41,154

[22] Filed: Apr. 22, 1987

[51] Int. Cl.[4] ..... H05B 37/00

[52] U.S. Cl. ..... 315/244; 315/228; 315/231; 315/250; 315/DIG. 5

[58] Field of Search ..... 315/206, 209 R, 228, 315/231, 248, 250, 294, 311, 244, 323, 324, DIG. 2, DIG. 4, DIG. 5, DIG. 7, 194, 195, 180

[56] References Cited

U.S. PATENT DOCUMENTS

| | | | |
|---|---|---|---|
| 4,127,795 | 11/1978 | Knoll | 315/209 R |
| 4,207,497 | 6/1980 | Capewell et al. | 315/DIG. 4 |
| 4,207,498 | 6/1980 | Spira et al. | 315/DIG. 4 |
| 4,210,846 | 7/1980 | Capewell et al. | 315/197 |
| 4,441,054 | 4/1984 | Bay | 315/DIG. 2 |
| 4,513,364 | 4/1985 | Nilssen | 315/DIG. 4 |
| 4,612,478 | 9/1986 | Payne | 315/DIG. 5 |
| 4,651,060 | 3/1987 | Clark | 315/DIG. 2 |

*Primary Examiner*—David K . Moore
*Assistant Examiner*—Mark L. Powell
*Attorney, Agent, or Firm*—Warren A. Sturm

[57] ABSTRACT

A high frequency system for gas discharge lamps includes a method of, and apparatus for, controlling the operation of a plurality of gas discharge lamps and provides; a reduction in starting and operating voltage and current; an increased range of dimming; and improved efficiency and reliability.

9 Claims, 7 Drawing Sheets

27
29
86
87
88
89
90
91
92
93
94
95
96
97
98
99
100
101
102
103
104
105
106
107
108
11
12
40
41
42
X
Y
Z

HIGH FREQUENCY LIGHTING SYSTEM FOR GAS DISCHARGE LAMPS

BACKGROUND OF THE INVENTION

1. Field of the Invention.

This invention relates generally to systems and methods of operation of gaseous discharge lamps and is more particularly directed to systems incorporating methods and apparatus for operating gaseous discharge lamps from a variable source of high frequency energy in the spectrum above that audible to the human sense organs.

2. Prior Art.

Representative prior art relating to the general field of my invention may be seen in the following patents:

| Patent No. | Issued | Title | Patentee |
|---|---|---|---|
| 3,889,153 | 6/10/75 | Power Source For Fluorescent Lamps And The Like | Pierce |
| 3,896,336 | 7/22/75 | Solid State Fluorescent Lamp Ballast System | Schreiner et al |
| 4,127,798 | 11/28/78 | Lamp Circuit | Anderson |
| 4,207,497 | 6/10/80 | Ballast Structure For Central High Frequency Dimming Apparatus | Capewell et al |
| 4,207,498 | 6/10/80 | System For Energizing And Dimming Gas Discharge Lamps | Spira et al |
| 4,210,846 | 7/1/80 | Inverter Circuit For Energizing And Dimming Gas Discharge Lamps | Capewell et al |
| 4,222,096 | 9/9/80 | D-C Power Supply Circuit With High Power Factor | Capewell et al |

In the realm of my experience with the subject matter of the above noted prior art, a number of deficiencies have arisen which are obviated by the novel and unobvious methods and apparatus of my invention as will be set forth below.

Among the deficiencies perceived in the prior art are a lack of ability to "light" the individual lamp connected to a source of high frequency power in a random sequence; to provide a substantial equality or balance of the light output of individual lamps when "lit" and to provide an effective dimming range of more than 50% of the maximum brightness of a given lamp.

BRIEF DESCRIPTION OF THE INVENTION

A method and apparatus for practicing the method will be set forth in detail below, however, briefly, my invention includes the concept and apparatus of providing a plurality of gaseous discharge lamps to be operated from a variable source of high frequency alternating current with one or the other of inductive or capacitive ballast devices which are substantially equal in number to provide a substantially unity power factor and which typically include a reactive element for alleviating or preventing the existence of assymmetry in the operation of a given gaseous discharge lamp and in which the values of the components are chosen to provide individual resonant frequencies that are greater than 10 percent above or below the frequency of the variable source of alternating current.

My invention further comprises protective devices and operational conditions under which the voltage of the variable source of alternating current is substantially that of the running voltage of the plurality of lamp units connected in parallel to the source of energy and include level responsive and timing means for initiating or re-initiating the operation of a given system after an overload condiditon so that at the initiation of operation, the voltage, or potential, of the variable source of alternating current energy gradually increases from a reduced value to the desired operational value.

In a typical application of the principles of my invention, a plurality of lamp units, consisting of a substantially equal number of units exhibiting capacitive or inductive ballast characteristics are connected in parallel to a source of high frequency alternating current energy of approximately 28.5 kilohertz that is controlled to provide an output voltage of approximately the rated running voltage of the gaseous discharge lamps contained in the lamp units and which is provided with a means for varying the output voltage from a lower value to the higher running value during a predetemined period of time for initial "lighting" of the individual lamp units, under which conditions, the individual lamp units may be observed to "light" in sequence (as may be confirmed by observing a substantially uniform low value of current approaching the running current of a given system) and which provides for "lighting" or starting of the individual lamp units at about the same voltage as the running voltage, and substantial balance in the light output of each of the lamp units for a given level of input voltage.

My invention further provides for an increased dimming range beyond the 50% normally attained with known systems by the addition of a reactive element disposed in proximity to and for coaction with an inductive portion of a lamp unit so as to react to an asymmetrical operation that is detrimental to individual lamps and which tends to prevent operation at low voltages required for increased dimming range and to effectively form a block as to any DC potentials existing between the electrodes of an individual lamp.

BRIEF DESCRIPTION OF THE DRAWING

FIG. 2 is a schematic and diagrammatic representation of a complete high frequency lighting system embodying a power supply as in FIG. 1 as well as a plurality of gaseous discharge lamps;

DESCRIPTION OF THE INVENTION

Figures 1, 4D:
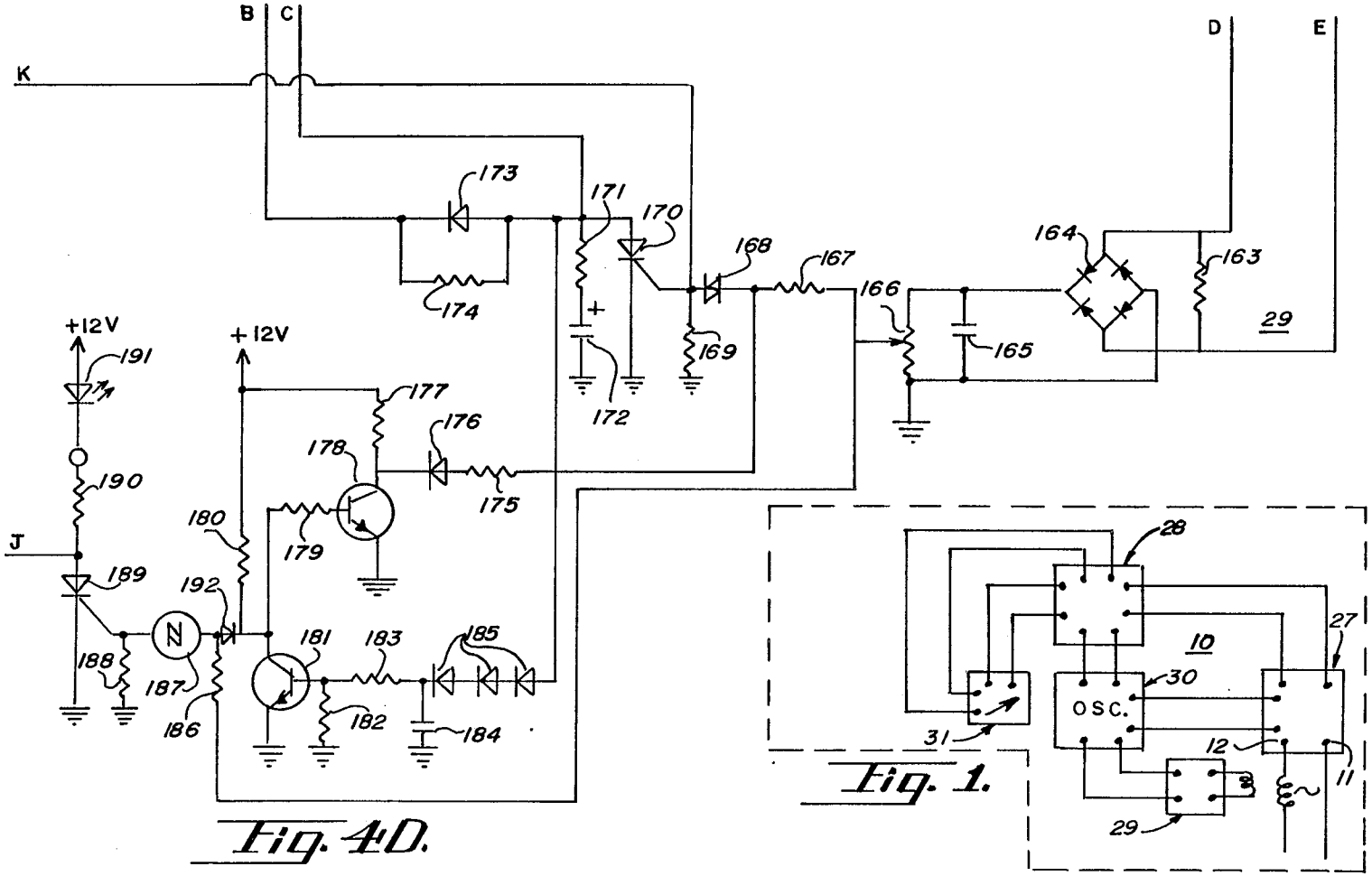
FIG. 1 is a schematic and diagrammatic representation of a high frequency source of alternating current energy.
Figure 6:
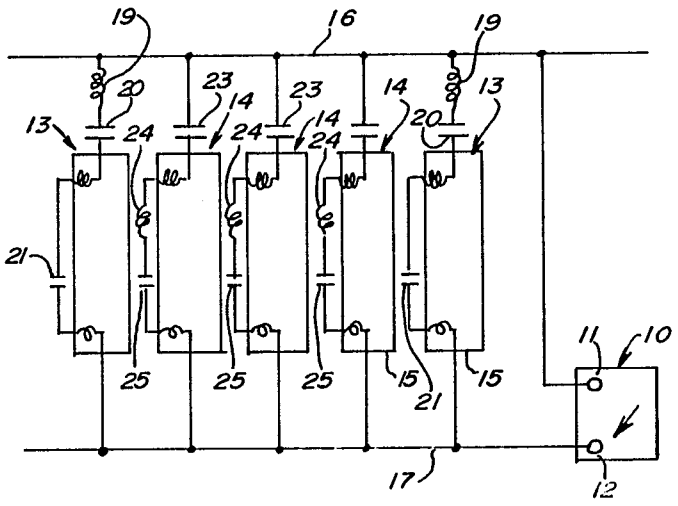
Figure 4B:
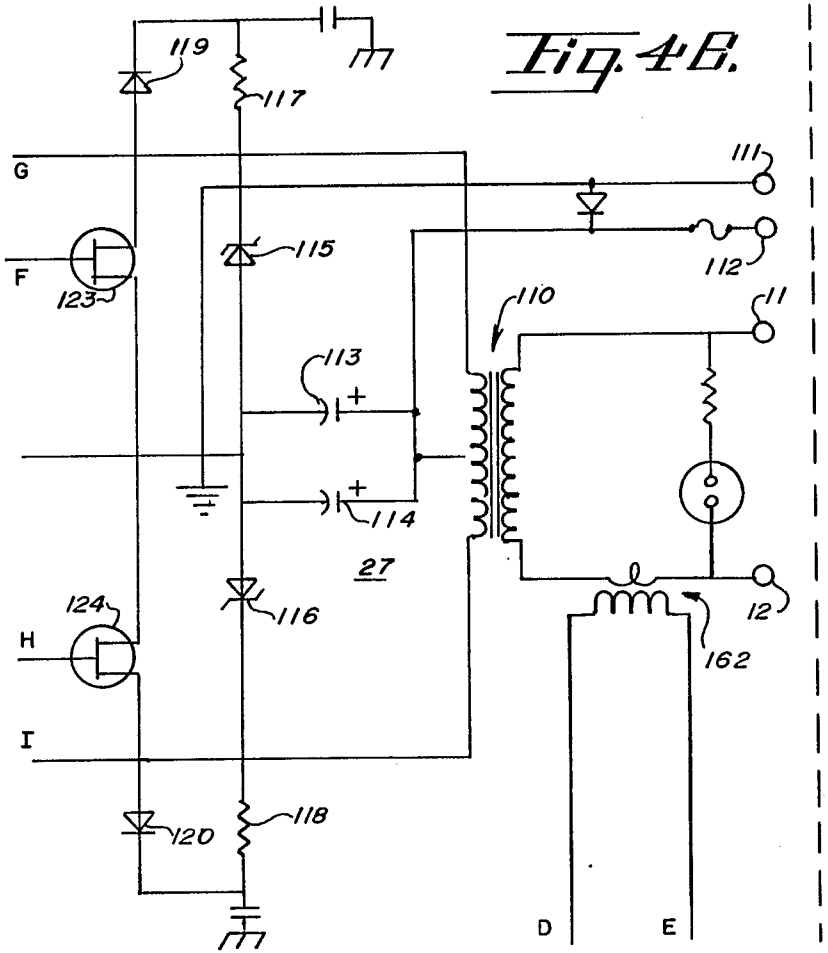
FIGS. 4A, B, C, D and E are electrical schematic drawings and a sketch indicating the manner in which the individual sheets may be assembled to form a composite drawing of a further embodiment of a power supply for use with my invention.

Referring to FIG. 2 of the drawings, a variable energy power supply is indicated generally by reference character 10 and includes a pair of output terminals 11 and 12 connected in circuit with essentially like pluralities of inductive, 13, or capacitive, 14, gaseous discharge lamp units, each including a gaseous discharge lamp 15, through conductors 16 and 17.

In FIG. 2 inductive gaseous discharge lamp unit 13 is shown comprised of an inductor 19 and capacitor 20 connected in series with a gaseous discharge lamp 15 which includes a capacitor 21 connector in parallel therewith. Capacitive gaseous discharge unit 14 includes a capacitor 23 connected in series with a gaseous discharge lamp 15 which, in turn, is connected in parallel with the series combination of inductor 24 and capacitor 25.

In the inductive and capacitive gaseous discharge lamp units 13 and 14 the following values were obtained for use in a system operable at a nominal frequency of 28.5 kilohertz;

| Reference Character | Component |
|---|---|
| 19 | 1.70 millihenry inductor |
| 20 | .66 microfarad capacitor |
| 21 | .0166 microfarad capacitor |
| 23 | .022 microfarad capacitor |
| 24 | 1.7 millihenry inductor |
| 25 | .66 microfarad capacitor |
| 15 | Sylvania Type F13DTT gaseous discharge lamp (13 watt, 65 volts line voltage). |

It may be noted that capacitors 20 and 25 are connected in series with inductors 19 and 24 respectively and are preferably more than ten times the capacity of capacitors 21 or 23.

Referring to FIG. 1 of the drawings a schematic and diagrammatic representation of a typical power supply, such as indicated by reference character 10, may include a source of DC power 28 operably connected to a control means 31 and to an oscillator 30 that is in turn connected to an inverter 27 having an alternating current output of approximately 28.5 kilohertz for connection to gaseous discharge lamp units 13 and 14 and to an output current sensing means 29.

As set forth below, the source of DC power may be, for example, a battery, as might be encountered in many portable power supply systems in trucks, boats, etc., or an AC power rectifying means as may be used in typical residential or commercial applications normally connected to commercial alternating power networks. It will also be seen that the two examples of power supplies set forth below in FIGS. 3 and 4 have common elements whereas one or the other may require fewer or more functions for satisfactory operation.

However, at this point in the description of my invention, it may be seen that a plurality of essentially like numbers of inductive and capacitive gaseous discharge lamp units 13 and 14 are connected in parallel to the output of a variable energy power supply, indicated generally by reference character 10. The values of the components are selected so that none of the gaseous discharge lamp units 13 or 14 will be resonant at the nominal operational frequency of a given system, in the case of the present embodiment, 28.5 kilohertz. Another way of describing the frequency characteristics of lamp units 13 and 14 is that they are designed to present a resonant frequency characteristic that is greater or less than the nominal operational frequency of high frequency power supply 10 by a factor or more than 10%.

While the illustrated embodiment shows gaseous discharge lamps 15 (FIG. 2) as including filaments, it is anticipated that other forms such as low pressure sodium, "instant start" fluorescent and high pressure lamps, such as the "Brite Arc" marketed by Sylvania may be used.

The operation of my system will be described first assuming all of the gaseous discharge lamp units have been satisfactoritly energized and are emitting light energy at the highest level possible. If this is what is desired by the user, no further action is required. However, under many conditions of operation, the user desires to reduce the amount of illumination as by dimming the gaseous discharge lamp units to a desired level and, in this event, control 31 is utilized to reduce the voltage supplied from power supply 10 and the level of illumination output of gaseous discharge lamp units may be reduced to a value considerably less than 50% of the maximum level. Typically, this is accomplished by reducing the direct current voltage level of source 28 to inverter 27 (as in FIG. 3 of the drawings, and maybe accomplished by connecting a transformer or the like (not shown) to the output terminals 11 and 12 of inverter 27 to thereby vary the voltage level of the high frequency alternating current energy).

In the event of a malfunction or the existence of a transient condition which may cause the load connected to power supply 10 to draw a current greater than a predetermined maximum value related to the capacity of power supply 10, current sensing means 29 is operable to turn power supply 10 to an off condition. This is typically accomplished by inhibiting the operation of oscillator 30 on a temporary or permanent basis. When the operation of oscillator 30 is inhibited on a temporary basis, such as many occur during a momentary overload condition when the system is initially started, or energized, control 31 may be operable to temporarily reduce the level of energy supplied to inverter 27 from DC power source 28 and to allow the level to increase to the maximum value at a rate determined by a timing circuit (to be described below) so as to permit ignition of all of the gaseous discharge lamp units connected in the system.

Figure 3A:
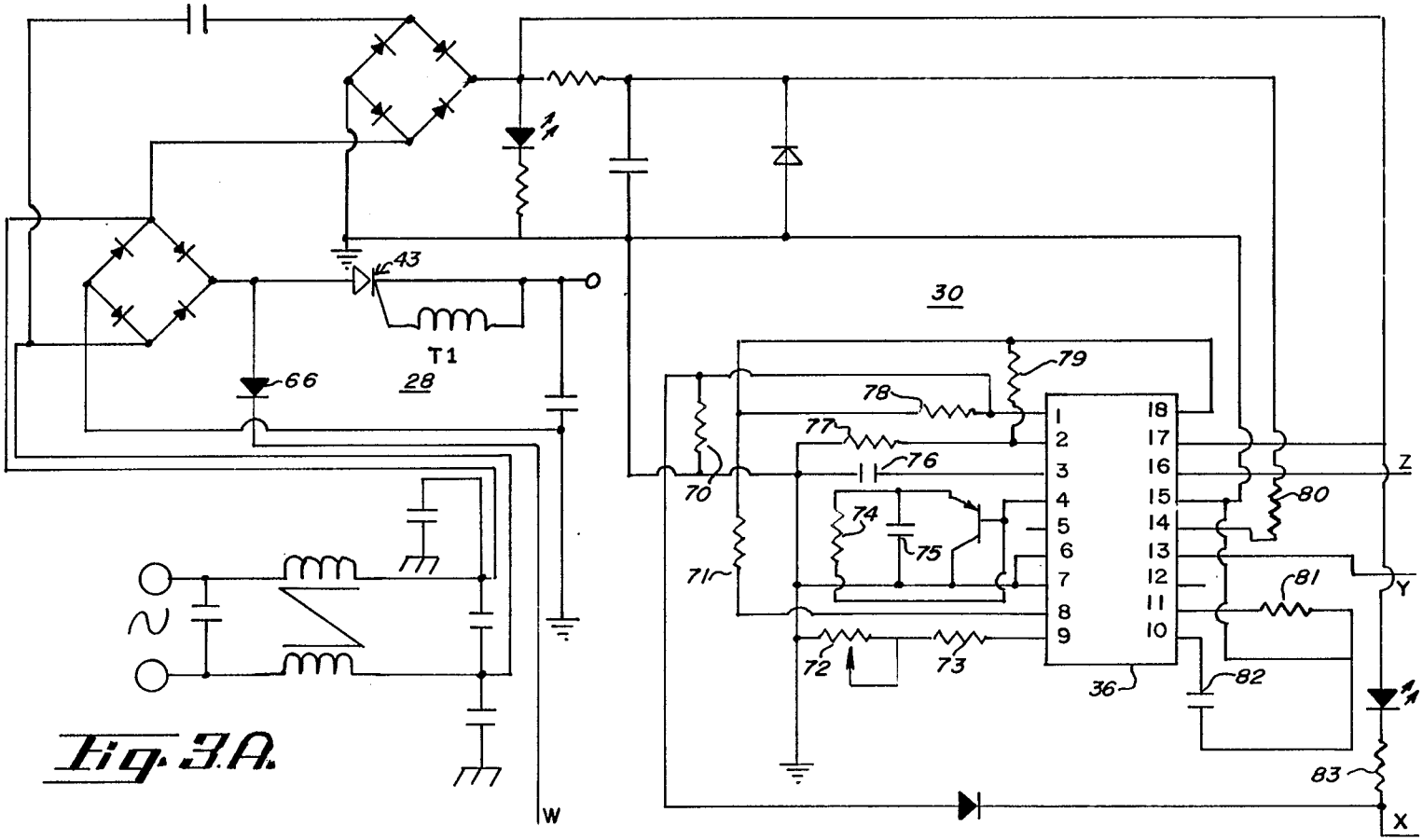
FIGS. 3A, B, C and D are electrical schematic drawings and a sketch illustrating the manner in which the individual sheets of drawings may be assembled into a full composite drawing of a power supply for use with my invention.
Figures 3A, 3B, 3C, 3D:
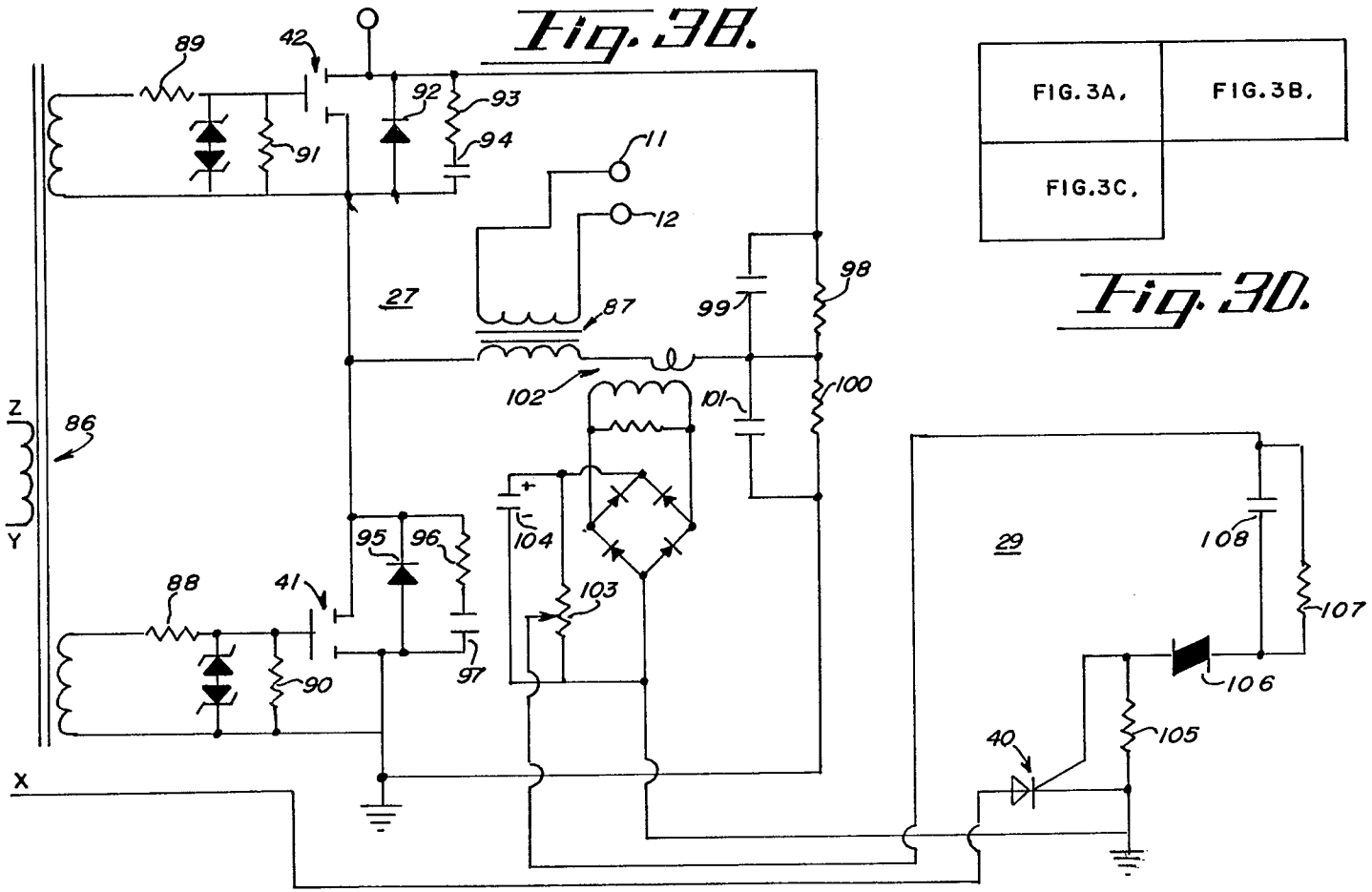

In an operative embodiment utilizing the power supply of FIG. 3A–C and gaseous discharge lamps 15, a system has been operational in which the voltage applied to the gaseous discharge lamp units has been in the neighborhood of the typical running voltage, such as 65 volts for full illumination at the onset of initiation of operation.) Each of the gaseous discharge lamp units will then operate to provide an increased level of voltage across each of the lamps 15 contained therein, and each of the units will become operational in a more or less random sequential manner which has been observed to be in a non-predetermined sequence so that the current load remains at a low-average level and the current capacity of power supply 10 is not exceeded. However, should the current capacity, of a predetermined level as determined by, for example, current sensing means 29, be exceeded, oscillator 30 will be shut down and the starting sequence reiniated by reducing the voltage below the normal running voltage and allowing it to increase in a ramped, or gradual fashion, to assist in ensuring that the individual lamp units start in a random sequence.

Following the ramping of the applied potential, or voltage, control 31 may be operable to reduce the voltage to that desired by the user of the system so that the individual lamp units may be dimmed to a desired level of illumination. The time for "ramping" or starting the lamp units of a system may be in the range of ⅛ to 3 seconds.

Referring to FIGS. 3A, B, and C, a complete power supply is shown including an inverter 27, a source of direct current power 28, current sensing means 29, an oscillator 30 and a control 31.

While the disclosure of the composite schematic diagram of FIG. 3A–C is believed straightforward, a number of the components and their values are identified for the convenience of those skilled in the art in practicing my invention;

| Reference Character | Component |
|---|---|
| 36 | Signetics type SG 3526N integrated circuit |
| 37 | Type 2N4403 transistor |
| 38 | Type 2N7646 transistor |
| 39 | Type 2N4403 transistor |
| 40 | Type 2N4992 SCR |
| 41, 42 | Type MTP8N20 FET transistors |
| 43 | RCA type S4060M SCR |
| 44 | 1 microfarad capacitor |
| 45 | 270K ohm resistor |
| 46 | 20 microfarad capacitor |
| 47 | 270K ohm resistor |
| 48 | 5K potentiometer |
| 49 | 5K ohm potentiometer |
| 50 | .1 microfarad capacitor |
| 51 | 417K ohm resistor |
| 52 | 1N4404 diode |
| 53 | 1N4404 diode |
| 54 | 1N4004 diode |
| 55 | 1N4004 diode |
| 56 | 20 V, 1 V Zener diode |
| 57 | 500 ohm potentiometer |
| 58 | 3.3K ohm resistor |
| 59 | 10K ohm resistor |
| 60 | 5.3K ohm resistor |
| 61 | 1K ohm potentiometer |
| 62 | 5 meg ohm potentiometer |
| 63 | 1N4004 diode |
| 64 | 200 microfarad capacitor |
| 65 | 5K ohm resistor |
| 66 | 1N4004 diode |

Integrated cirucuit 36 is shown having a plurality of numbered terminals which are connected to and interconnected with the following compontents;

| Reference Character | Component |
|---|---|
| 70 | 22K ohm resistor |
| 71 | 10K ohm resistor |
| 72 | 1K ohm potentiometer |
| 73 | 1.8K ohm resistor |
| 74 | 100 ohm resistor |
| 75 | 2204F microfarad capacitor |
| 76 | .005 microfarad capcacitor |
| 77 | 22K ohm resistor |
| 78 | 22K ohm resistor |
| 79 | 47K ohm resistor |
| 80 | 88 ohm resistor |
| 81 | 36K ohm resistor |
| 82 | .01 microfarad capacitor |
| 83 | 3.3K ohm resistor |

Figure 3C:
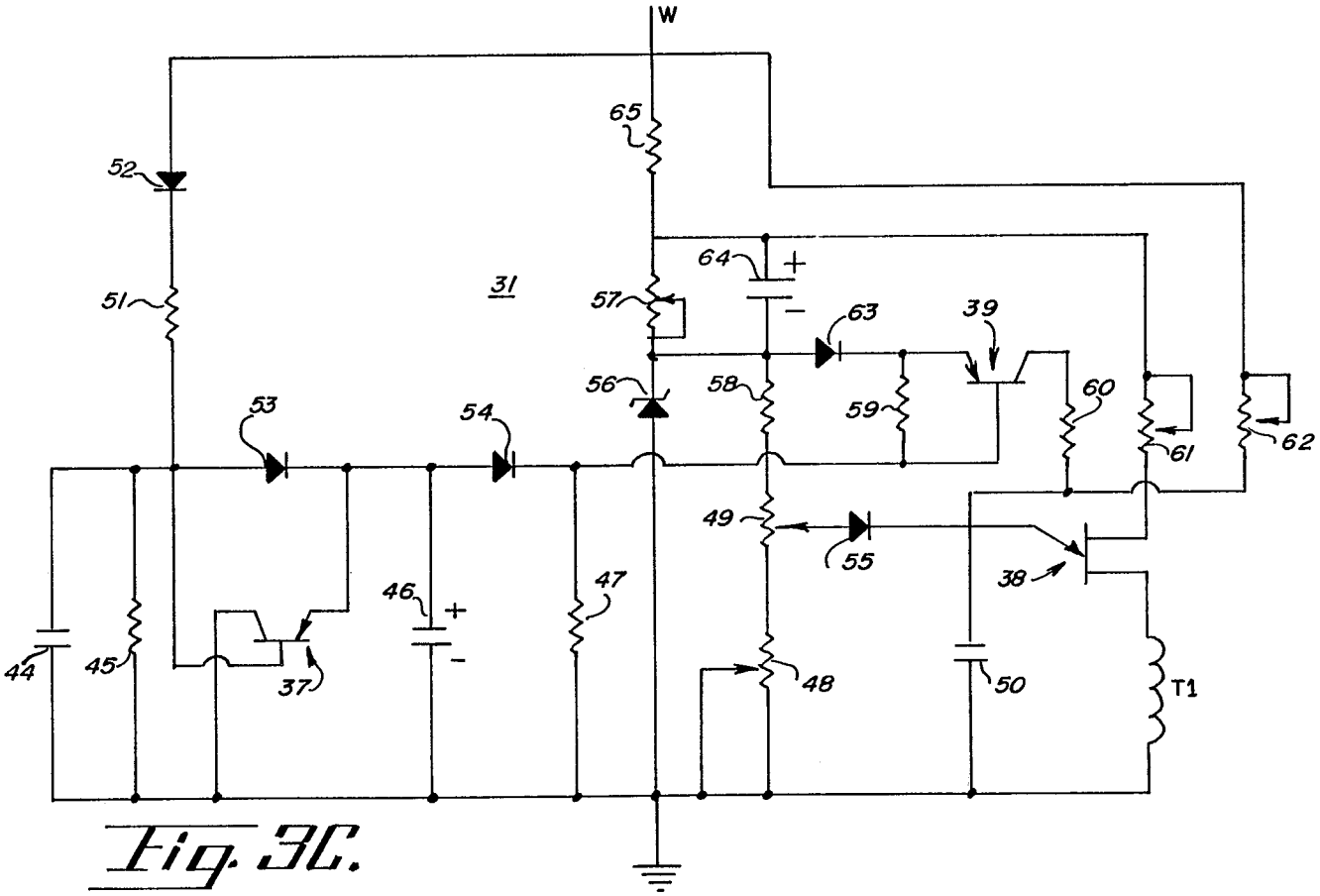
Figures 4A, 4E:
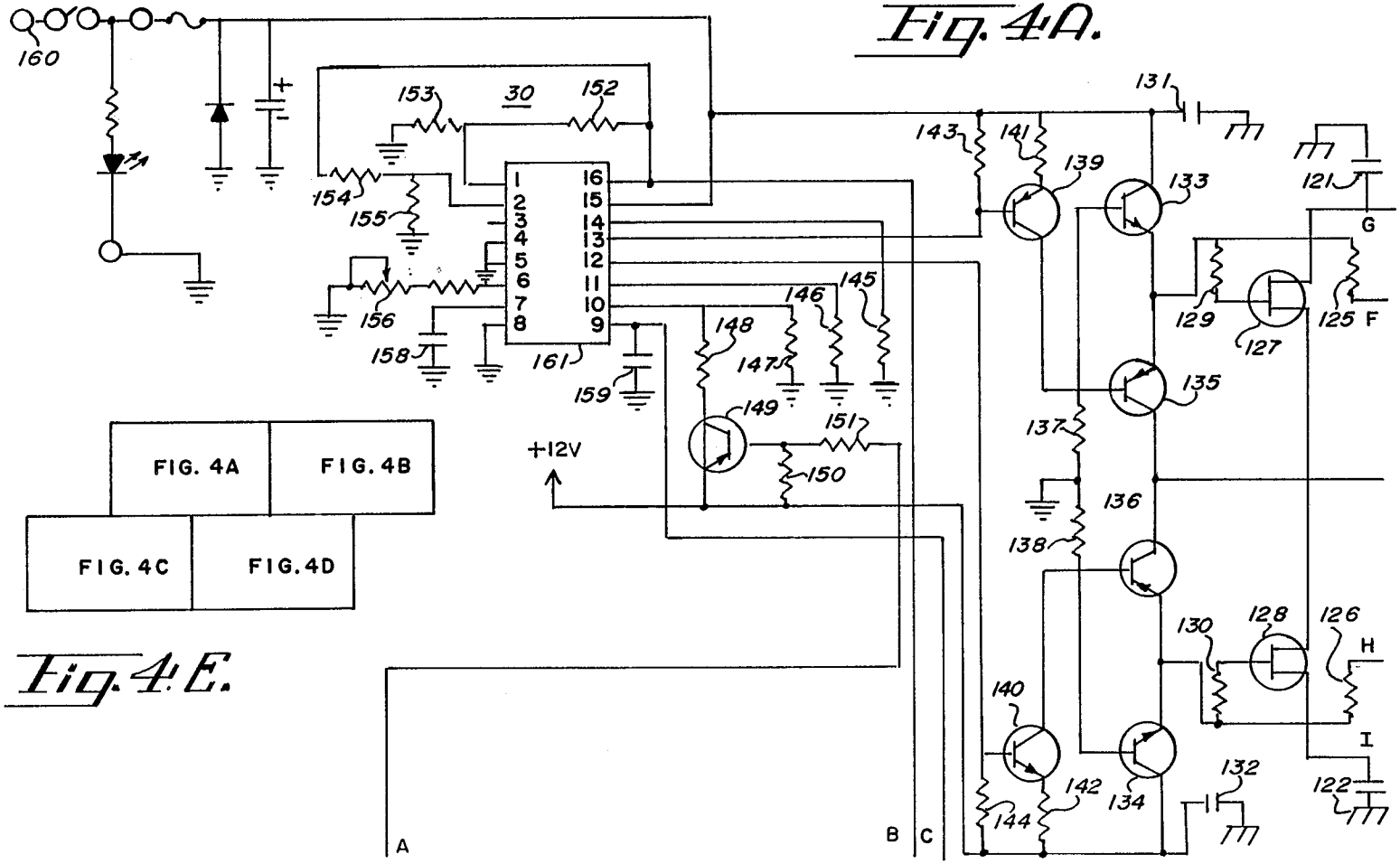
Figure 4C:
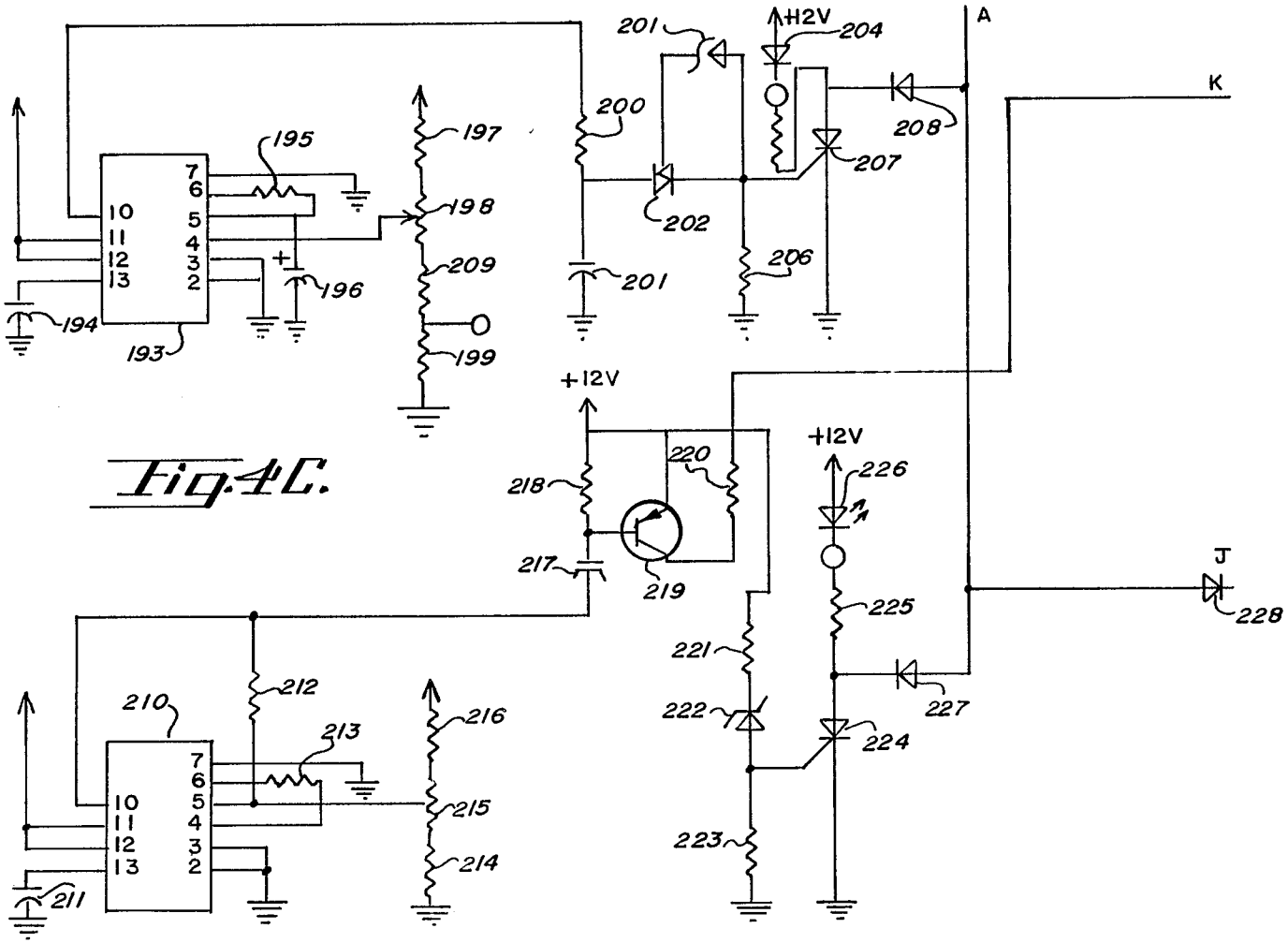

Other components in FIG. 3 may be indentified as follows, inverter 27;

| Reference Character | Component |
|---|---|
| 86 | input transformer |
| 87 | output transformer |
| 88 | 33 ohm resistor |
| 89 | 33 ohm resistor |
| 90 | 10K ohm resistor |
| 91 | 10K ohm resistor |
| 92 | 1N4936 diode |

-continued

| Reference Character | Component |
|---|---|
| 93 | 33 ohm resistor |
| 94 | 150 picofarad capacitor |
| 95 | 1N4936 diode |
| 96 | 33 ohm resistor |
| 97 | 150 picofarad capacitor |
| 98 | 68K ohm resistor |
| 99 | 220 microfarad capacitor |
| 100 | 68K ohm resistor |
| 101 | 200 microfarad capacitor |
| 102 | current transformer |

In current sensing means 29;

| Reference Character | Component |
|---|---|
| 103 | 1K ohm potentiometer |
| 104 | 47 microfarad capacitor |
| 105 | 10K ohm resistor |
| 106 | 2N4992 diode |
| 107 | 10K ohm resistor |
| 108 | .01 microfarad capacitor |

Control circuit 31 provides for a dimming control through the adjustment of potientiometer 49 and the duty cycle of SCR 43 in DC power source 28 is thereby determined so as to effect control of the dimming.

In the embodiment of FIG. 3A–C, capacitor 75 is connected to terminal 4 on integrated circuit 36 to provide for a "soft" startup, or a "ramping" of the voltage rise of terminal 4 upon initial energization or connection of the apparatus of FIG. 3A–C to a source of alternating current. Capacitor 75 is discharged when power is turned off so that the "soft" start or "ramping" is restored to be available for the next starting procedure.

Referring to FIGS. 3A–C, the illustrated power supply, 28, is intended to be operational from a commercial power grid typically supplying a relatively low voltage, 100 volts, 60 cycle alternating current. This is connected to appropriate rectifiers through suitable filter means to provide DC power for control 31 and oscillator and 30 on one hand and converter 27 on the other hand. It may be noted that the level of power that may be supplied to converter 27 is controlled by the operation of SCR 43 in power supply 28, that is in turn controlled by the secondary winding of transformer T1, having a primary winding connected to semi-conductor 38 in control 31. An overcurrent shutdown is provided by the current sensing portion 29 of FIG. 3 and is operable to disable integrated circuit 36 in oscillator 30 at such time as a predetermined output current is exceeded.

The operation of control 31 is inhibited when the power supply of FIGS. 3A–C is initially started so as to provide full voltage to the lamp units to be energized. This is accomplished by rendering transistor 39 conductive for a predetermined time depending upon the time interval determined by capacitor 46 connected to transistor 37.

The following is a table of values for the various components utilized in the schematic drawing of FIGS. 4A–D.

| Reference Character | Component |
|---|---|
| 110 | Output transformer |
| 111, 112 | Input power terminals for connections to a source of DC power |

-continued

| Reference Character | Component |
|---|---|
| 113 | 2.00 microfarad capacitor |
| 114 | 2.00 microfarad capacitor |
| 115 | 1.5KE39A diode |
| 116 | 1.5KE39A diode |
| 117 | 220 ohm resistor |
| 118 | 220 ohm resistor |
| 119 | Type 1N 4936 diode |
| 120 | Type 1N 4936 diode |
| 121 | .01 microfarad capacitor |
| 122 | .01 microfarad capacitor |
| 123 | Type MTP3055A transistor |
| 124 | Type MTP3055A transistor |
| 125 | 220 ohm resistor |
| 126 | 220 ohm resistor |
| 127 | Type MTP3055A transistor |
| 128 | Type MTP3055A transistor |
| 129 | 220 ohm resistor |
| 130 | 220 ohm resistor |
| 131 | .33 microfarad capacitor |
| 132 | .33 microfarad capacitor |
| 133 | Type 2N 3706 transistor |
| 134 | Type 2N 3706 transistor |
| 135 | Type 2N 4403 transistor |
| 136 | Type 2N 4403 transistor |
| 137 | 220 ohm resistor |
| 138 | 220 ohm resistor |
| 139 | Type 2N 4403 transistor |
| 140 | Type 2N 4403 transistor |
| 141 | 22 ohm resistor |
| 142 | 22 ohm resistor |
| 143 | 82 ohm resistor |
| 144 | 82 ohm resistor |
| 145 | 300 ohm resistor |
| 146 | 300 ohm resistor |
| 147 | 2.2K ohm resistor |
| 148 | 2.2K ohm resistor |
| 149 | Type 2N 4403 transistor |
| 150 | 10K ohm resistor |
| 151 | 2.2K ohm resistor |
| 152 | 47K ohm resistor |
| 153 | 22K ohm resistor |
| 154 | 22K ohm resistor |
| 155 | 22K ohm resistor |
| 156 | 1K potentiometer |
| 157 | 470 ohm resistor |
| 158 | .02 microfarad capacitor |
| 159 | .005 microfarad capacitor |
| 160 | Terminal for connection to a source of positive direct current voltage, nominally 12 volts |
| 161 | Type 3524B integrated circuit —oscillator |
| 162 | Transformer |
| 163 | 470 ohm resistor |
| 164 | Full wave rectifying bridge comprised of type 1N 4001 diodes |
| 165 | .47 microfarad capacitor |
| 166 | 1K ohm potentiometer |
| 167 | 22K ohm resistor |
| 168 | Type 2N 4992 diode |
| 169 | 2.2K ohm resistor |
| 170 | C103 SCR |
| 171 | 470 ohm resistor |
| 172 | 220 microfarad capacitor |
| 173 | Type 1N 4000 diode |
| 174 | 100K ohm resistor |
| 175 | 10K ohm resistor |
| 176 | Type 1N 4000 diode |
| 177 | 4.7K ohm resistor |
| 178 | Type 2N 3706 transistor |
| 179 | 10K ohm resistor |
| 180 | 2.2K ohm resistor |
| 181 | Type 2N 3706 transistor |
| 182 | 47K ohm resistor |
| 183 | 10K ohm resistor |
| 184 | .47 microfarad capacitor |
| 185 | Type 1N 4000 diode |
| 186 | 22K ohm resistor |
| 187 | Type 2N 4992 diode |

-continued

| Reference Character | Component |
|---|---|
| 188 | 2.2K ohm resistor |
| 189 | Type C103 SCR |
| 190 | 470 ohm resistor |
| 191 | Light emitting diode |
| 192 | Type 1N 4000 diode |
| 193 | Type 723 integrated circuit |
| 194 | .068 microfarad capacitor |
| 195 | 15K ohm resistor |
| 196 | .47 microfarad capacitor |
| 197 | 1K ohm resistor |
| 198 | 1K ohm potentiometer |
| 199 | 470 ohm resistor |
| 200 | 22K ohm resistor |
| 201 | .01 microfarad capacitor |
| 202 | Type 2N 4992 diode |
| 203 | Type 1N 753 diode |
| 204 | Light emitting diode |
| 205 | 470K ohm resistor |
| 206 | 2.2K ohm resistor |
| 207 | Type 103 SCR |
| 208 | Type 1N 4000 diode |
| 209 | 470 ohm resistor |
| 210 | Type 723 integrated circuit |
| 211 | .068 microfarad capacitor |
| 212 | 10K ohm resistor |
| 213 | 4.7K ohm resistor |
| 214 | 1K ohm resistor |
| 215 | 1K ohm potentiometer |
| 216 | 1K ohm resistor |
| 217 | .47 microfarad capacitor |
| 218 | 10K ohm resistor |
| 219 | Type 2N 4403 transistor |
| 220 | 2.2K ohm resistor |
| 221 | 85 ohm resistor |
| 222 | Type 1N 4745A diode |
| 223 | 2.2K ohm resistor |
| 224 | Type C103 SCR |
| 225 | 470 ohm resistor |
| 226 | Light emitting diode |
| 227 | Type 1N 4000 diode |
| 228 | Type 1N 4000 diode |

FIGS. 4A–D are similarly identified as including a convertor 27, current sensing means 29 and an oscillator 30, all of which is connected to a source of direct current energy, such as a battery (not shown).

The operation of the illustration of FIGS. 4A–D is generally similar to that described above in connection with FIGS. 1 and 3A–C and for specific details of operation, resort may be had to the fabrication of the apparatus therein illustrated.

In the power supply of FIGS. 4A–D, capacitor 172 is utilized to provide the "ramping" or "soft" start, gradually rising drive characteristics for oscillator 30 comprised of integrated circuit 161. The "ramping" on the initial startup is repeated each time the apparatus is shut down as for example, by disconnection from the power supply or by the sensing of an overcurrent at the output of convertor 27 at terminals 11 and 12.

I claim:

1. In a high frequency lighting system, the combination, comprising;

a variable source of high frequency current;

a plurality of lamp units, each including first and second terminals for connection to said variable source of high frequency current and an intermediate terminal and having capacitive means connected intermediate said first terminal and said intermediate terminal and inductive and direct current blocking capacitive means connected in series intermediate said second terminal and said intermediate terminal and a gaseous discharge lamp connected in parallel with half of said capacitive means and half of said inductive and capacitive means, said capacitive and inductive means being proportioned so that half of said lamp units exhibit a resonant frequency of thirteen to twenty percent less than the frequency of said variable source of high frequency current and the other half of said lamp units exhibit a resonant frequency of thirteen to twenty percent greater than said variable source of high frequency current;

means connecting the first and second terminals of said plurality of lamp units in parallel with said variable source of high frequency current; and means connected to said variable source of high frequency current for controlling the output thereof.

2. In a high frequency lighting system, the combination comprising;

a variable source of high frequency current; a plurality of lamp units, each including first and second terminals for connection to said variable source of high frequency current and an intermediate terminal and having first capacitive means connected intermediate said first terminal and said intermediate terminal and inductive and second direct current blocking capacitive means connected in series intermediate said second terminal and said intermediate terminal and a gaseous discharge lamp connected in parallel with said first capacitive means or said inductive and second capacitive means so that approximately one-half of said lamp units are capacitive in nature and approximately one-half of said lamp units are inductive in nature;

means connected to said source of high frequency current for controlling the output thereof; and means connecting the output of said last-named means to the first and second terminals on each of plurality of lamp units, whereby, upon energization, said lamp units become conductively luminous in a random sequence.

3. The apparatus of claim 1 or 2 in which the maximum output of the source of high frequency current is substantially the running voltage of the lamp units.

4. The apparatus of claim 2 in which one of the plurality of lamp units is operable at a resonant frequency higher than the source of high frequency current and the other of the plurality of lamp units is operable at a resonant frequency lower than the source of high frequency current.

5. The apparatus of claim 1 in which the variable source of high frequency current includes voltage regulating means.

6. The apparatus of claim 1 in which the means for controlling the output level of the source of high frequency current is comprised of level dividing reactance means.

7. The apparatus of claim 6 in which the level dividing reactance means is a transformer.

8. The method of operating a lighting system comprised of a plurality of first and second gaseous discharge lamps; comprising the steps of;

providing a variable source of high frequency current; providing a first plurality of gaseous discharge lamp units, each said unit including an inductive ballast means in which said inductor is series connected to a direct current blocking capacitive reactance means;

providing a second plurality of gaseous discharge lamp units, each said unit including a capacitive ballast is connected to an inductor is connected in series with a direct current blocking capacitive reactance means;

simultaneously connecting all of said gaseous discharge lamp units to said source of high frequency current.

9. The method of claim 8 and the step of rendering the ballasts for the inductive or capacitative gaseous discharge lamp units resonant at a frequency other than the frequency of the source of high frequency current.

* * * * *